US009664088B2

(12) United States Patent
Katayama et al.

(10) Patent No.: US 9,664,088 B2
(45) Date of Patent: May 30, 2017

(54) CATALYST REGENERATION PROCESSING APPARATUS

(71) Applicant: TOYOTA JIDOSHA KABUSHIKI KAISHA, Toyota-shi, Aichi-ken (JP)

(72) Inventors: Masanobu Katayama, Seto (JP); Itsuya Kurisaka, Nisshin (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 15/078,337

(22) Filed: Mar. 23, 2016

(65) Prior Publication Data

US 2016/0290207 A1 Oct. 6, 2016

(30) Foreign Application Priority Data

Apr. 2, 2015 (JP) ..... 2015-076018

(51) Int. Cl.
*F01N 3/00* (2006.01)
*F01N 9/00* (2006.01)
(Continued)

(52) U.S. Cl.
CPC ..... *F01N 9/00* (2013.01); *F01N 3/021* (2013.01); *F01N 3/085* (2013.01); *F01N 3/0814* (2013.01); *F01N 3/0842* (2013.01); *F01N 3/0885* (2013.01); *F01N 13/008* (2013.01); *F01N 2250/02* (2013.01); *F01N 2550/03* (2013.01); *F01N 2560/06* (2013.01); *F01N 2570/04* (2013.01); *F01N 2570/14* (2013.01); *F01N 2900/08* (2013.01); *F01N 2900/1404* (2013.01); *F01N 2900/1612* (2013.01)

(58) Field of Classification Search
USPC ..... 60/276, 277, 286, 295, 297, 301, 303
See application file for complete search history.

(56) References Cited

U.S. PATENT DOCUMENTS 6,637,198 B2 * 10/2003 Hertzberg ..... B01D 53/9481 60/274
7,054,734 B2 * 5/2006 Todoroki ..... F01N 3/0821 60/274

(Continued)

FOREIGN PATENT DOCUMENTS

JP 2002-256951 A 9/2002
JP 2008-286042 A 11/2008

*Primary Examiner* — Binh Q Tran
(74) *Attorney, Agent, or Firm* — Oliff PLC

(57) ABSTRACT

A catalyst regeneration processing apparatus for an internal-combustion engine includes an electronic control unit. The electronic control unit is configured to determine whether a gap is equal to a predetermined degree or less, the gap being a difference between (a) a progress degree of heat deterioration of a NOx catalyst in a predetermined time in a case of assuming that a regeneration process is executed for the predetermined time and (b) a progress degree of heat deterioration of the NOx catalyst in the predetermined time in a case of assuming that the regeneration process is not executed. The electronic control unit is configured to execute the regeneration process in a case of determining that the gap is equal to the predetermined degree or less, even when a sulfur poisoning quantity does not exceed a permissible upper limit quantity.

8 Claims, 3 Drawing Sheets

(51) Int. Cl.

| | |
|---|---|
| ***F01N 3/08*** | (2006.01) |
| ***F01N 3/021*** | (2006.01) |
| ***F01N 13/00*** | (2010.01) |

(56) References Cited

U.S. PATENT DOCUMENTS

| | | | | |
|---|---|---|---|---|
| 8,276,369 | B2 * | 10/2012 | Nishioka | B01D 46/006 60/285 |
| 8,621,852 | B2 * | 1/2014 | Oshikawa | G01N 33/0042 60/276 |
| 8,745,972 | B2 * | 6/2014 | Yoshida | F02D 41/028 60/274 |
| 8,820,048 | B2 * | 9/2014 | Seo | F01N 9/007 60/274 |
| 2010/0115924 | A1 | 5/2010 | Gabe et al. | |

* cited by examiner

CATALYST REGENERATION PROCESSING APPARATUS

INCORPORATION BY REFERENCE

The disclosure of Japanese Patent Application No. 2015-076018 filed on Apr. 2, 2015 including the specification, drawings and abstract is incorporated herein by reference in its entirety.

BACKGROUND

1. Technical Field

The disclosure relates to a catalyst regeneration processing apparatus to perform a regeneration process of a NOx catalyst that is disposed in an exhaust passage of an internal-combustion engine.

2. Description of Related Art

Japanese Patent Application Publication No. 2002-256951 describes an example of a catalyst regeneration processing apparatus that executes a regeneration process of a NOx catalyst. The apparatus decides whether to execute the regeneration process, based on two deteriorations of the NOx catalyst, that is, a deterioration by sulfur poisoning and a deterioration by heat.

SUMMARY

When the above regeneration process is executed, the temperature of the NOx catalyst becomes high, and therefore, the heat deterioration of the NOx catalyst progresses. Further, depending on the operation state of an internal-combustion engine, the temperature of the NOx catalyst sometimes becomes relatively high, even when the regeneration process is not executed. In this case, the heat deterioration of the NOx catalyst progresses further.

The embodiments provide a catalyst regeneration processing apparatus that makes it possible to suppress the progress of the heat deterioration of the NOx catalyst.

One aspect relates to a catalyst regeneration processing apparatus for an internal-combustion engine. The internal-combustion engine includes a NOx catalyst that is disposed in an exhaust passage. The catalyst regeneration processing apparatus includes an electronic control unit. The electronic control unit is configured to calculate a sulfur poisoning quantity of the NOx catalyst. The electronic control unit is configured to control the internal-combustion engine such that a regeneration process is executed, in a case where the sulfur poisoning quantity exceeds a permissible upper limit quantity, the regeneration process being a process of raising a temperature of the NOx catalyst so as to reduce the sulfur poisoning quantity. The electronic control unit is configured to determine whether a gap is equal to a predetermined degree or less, the gap being a difference between (a) a progress degree of heat deterioration of the NOx catalyst in a predetermined time in a case of assuming that the regeneration process is executed for the predetermined time and (b) a progress degree of heat deterioration of the NOx catalyst in the predetermined time in a case of assuming that the regeneration process is not executed. The electronic control unit is configured to execute the regeneration process in a case of determining that the gap is equal to the predetermined degree or less, even when the sulfur poisoning quantity does not exceed the permissible upper limit quantity.

According to the above aspect, the regeneration process for sulfur poisoning is executed with the condition that the sulfur poisoning quantity exceeds the permissible upper limit quantity. In the case where the regeneration process for sulfur poisoning is executed, the temperature of the NOx catalyst is increased to a high temperature that is appropriate for the regeneration process, and therefore, the heat deterioration of the NOx catalyst is prone to progress. Furthermore, the heat deterioration of the NOx catalyst may progress largely compared to the case of assuming that the regeneration process is not executed.

On the contrary, in the above aspect, even when the sulfur poisoning quantity does not exceed the permissible upper limit quantity, the regeneration process is executed when the condition is satisfied that the difference in the progress degree of heat deterioration of the NOx catalyst between (a) the case where the regeneration process is executed for the predetermined time and (b) the case where the regeneration process is not executed, is equal to the predetermined degree or less. In the case where the regeneration process is executed because the difference is equal to the above predetermined degree or less, there is no great difference in the progress degree of the heat deterioration of the NOx catalyst from the case where the regeneration process is not executed, but the sulfur poisoning quantity is reduced. Thereby, it is possible to decrease the frequency at which the sulfur poisoning quantity exceeds the permissible upper limit quantity. Then, since it is possible to decrease the frequency at which the sulfur poisoning quantity exceeds the permissible upper limit quantity, it is possible to suppress the progress of the heat deterioration of the NOx catalyst.

In the catalyst regeneration processing apparatus according to the above aspect, the electronic control unit may be configured to determine whether the gap is equal to the predetermined degree or less, based on a current value of the temperature of the NOx catalyst. In a period nearly equivalent to the execution time of the regeneration process, it is likely that the change quantity of the temperature of the NOx catalyst increases little. Therefore, when the current time is adopted as a starting point, it is possible to approximate a near-future temperature of the NOx catalyst in the period nearly equivalent to the execution time of the regeneration process, with a high accuracy, by the current temperature of the NOx catalyst. Thus, whether the gap is equal to the predetermined degree or less is determined based on the current temperature of the NOx catalyst.

In the catalyst regeneration processing apparatus according to the above aspect, the electronic control unit may be configured to predict the progress degree of heat deterioration of the NOx catalyst in the predetermined time in the case of assuming that the regeneration process is not executed, based on the current value of the temperature of the NOx catalyst. The electronic control unit also may be configured to determine whether the gap is equal to the predetermined degree or less, based on the progress degree of heat deterioration predicted based on the current value of the temperature of the NOx catalyst.

In a period nearly equivalent to the execution time of the regeneration process, it is likely that the change quantity of the temperature of the NOx catalyst increases little. Therefore, when the current time is adopted as a starting point, it is possible to approximate a near-future temperature of the NOx catalyst in the period nearly equivalent to the execution time of the regeneration process, with a high accuracy, by the current temperature of the NOx catalyst. Thus, the heat deterioration degree of the NOx catalyst in the predetermined time in the case of assuming that the regeneration process is not executed is predicted based on the current temperature of the NOx catalyst.

In the catalyst regeneration processing apparatus according to the above aspect, the electronic control unit may be configured to calculate a deterioration degree of the NOx catalyst, based on a history of the temperature of the NOx catalyst. The electronic control unit may be configured to predict the progress degree of heat deterioration, based on the deterioration degree calculated based on the history.

The progress degree of heat deterioration of the NOx catalyst depends on the deterioration degree at the current time point. Hence, the progress degree of the heat deterioration is predicted in consideration of the deterioration degree at the current time point based on the history. Thereby, it is possible to perform a prediction that reflects the dependence of the progress degree of heat deterioration on the deterioration degree at the current time point, and furthermore, it is possible to predict the progress degree of heat deterioration with a higher accuracy.

In the catalyst regeneration processing apparatus according to the above aspect, the electronic control unit may be configured to calculate a deterioration degree of the NOx catalyst based on a history of the temperature of the NOx catalyst. The electronic control unit may be configured to predict the progress degree of heat deterioration of the NOx catalyst in the predetermined time in the case of assuming that the regeneration process is executed for the predetermined time, based on the deterioration degree calculated based on the history. The electronic control unit may be configured to determine whether the gap is equal to the predetermined degree or less, based on the predicted progress degree of heat deterioration.

The progress degree of heat deterioration of the NOx catalyst depends on the deterioration degree at the current time point. Hence, the progress degree of heat deterioration is predicted in consideration of the deterioration degree at the current time point based on the history. Thereby, it is possible to perform a prediction that reflects the dependence of the progress degree of heat deterioration on the deterioration degree at the current time point, and furthermore, it is possible to predict the progress degree of heat deterioration with a higher accuracy.

In the catalyst regeneration processing apparatus according to the above aspect, the electronic control unit may be configured to predict a time required for the regeneration process in a case where the regeneration process is executed, based on an average rotational speed and an average injection quantity of the internal-combustion engine in a predetermined period. The predetermined time may be the predicted time required for the regeneration process.

The regeneration efficiency of the regeneration process depends on the rotational speed and the injection quantity of the internal-combustion engine. Therefore, the time required for the regeneration process depends on the rotational speed and the injection quantity of the internal-combustion engine during the regeneration process. Meanwhile, it is likely that the change quantities of the rotational speed and the injection quantity of the internal-combustion engine are small in the short term. Therefore, it is possible to approximate the rotational speed and the injection quantity of the internal-combustion engine during the regeneration process, by the average rotational speed and average injection quantity in the predetermined period. Accordingly, the time required for the regeneration process is predicted based on the average rotational speed and the average injection quantity in the predetermined period. Thereby, it is possible to predict the time required for the regeneration process, with a higher accuracy, compared to, for example, the case of assuming that the rotational speed and the injection quantity in the predetermined time are previously supposed values.

In the catalyst regeneration processing apparatus according to the above aspect, the electronic control unit may be configured to set the permissible upper limit quantity, based on a history of the temperature of the NOx catalyst. The performance of the NOx catalyst depends on the heat deterioration. In the case where the regeneration process is executed with the condition that the sulfur poisoning quantity becomes the permissible upper limit quantity without considering the heat deterioration degree of the NOx catalyst, the permissible upper limit quantity is set in accordance with a case where the heat deterioration degree is great. Then, in this case, when the heat deterioration does not progress and the regeneration process does not need to be executed yet, the regeneration process is executed. In response, the permissible upper limit quantity is set depending on the history of the temperature of the NOx catalyst, and thereby, the permissible upper limit quantity can be set so as to be variable depending on the heat deterioration degree of the NOx catalyst. Therefore, it is possible to suppress the execution of the regeneration process, and furthermore, it is possible to suppress the heat deterioration of the NOx catalyst.

In the catalyst regeneration processing apparatus according to the above aspect, the temperature of the NOx catalyst in the regeneration process may be higher than a highest value of the temperature of the NOx catalyst in a case where the regeneration process is not executed.

According to the above aspect, the temperature of the NOx catalyst is lower than the temperature at the time of the regeneration process, unless the regeneration process is executed by the electronic control unit. Therefore, when the gap is equal to the predetermined degree or less, the progress degree of heat deterioration of the NOx catalyst in the case where the regeneration process is not executed is smaller, but is not much different from the progress degree of heat deterioration in the case where the regeneration process is executed.

BRIEF DESCRIPTION OF THE DRAWINGS

Features, advantages, and technical and industrial significance of exemplary embodiments will be described below with reference to the accompanying drawings, in which like numerals denote like elements, and wherein.

DETAILED DESCRIPTION OF EMBODIMENTS

Figure 1:
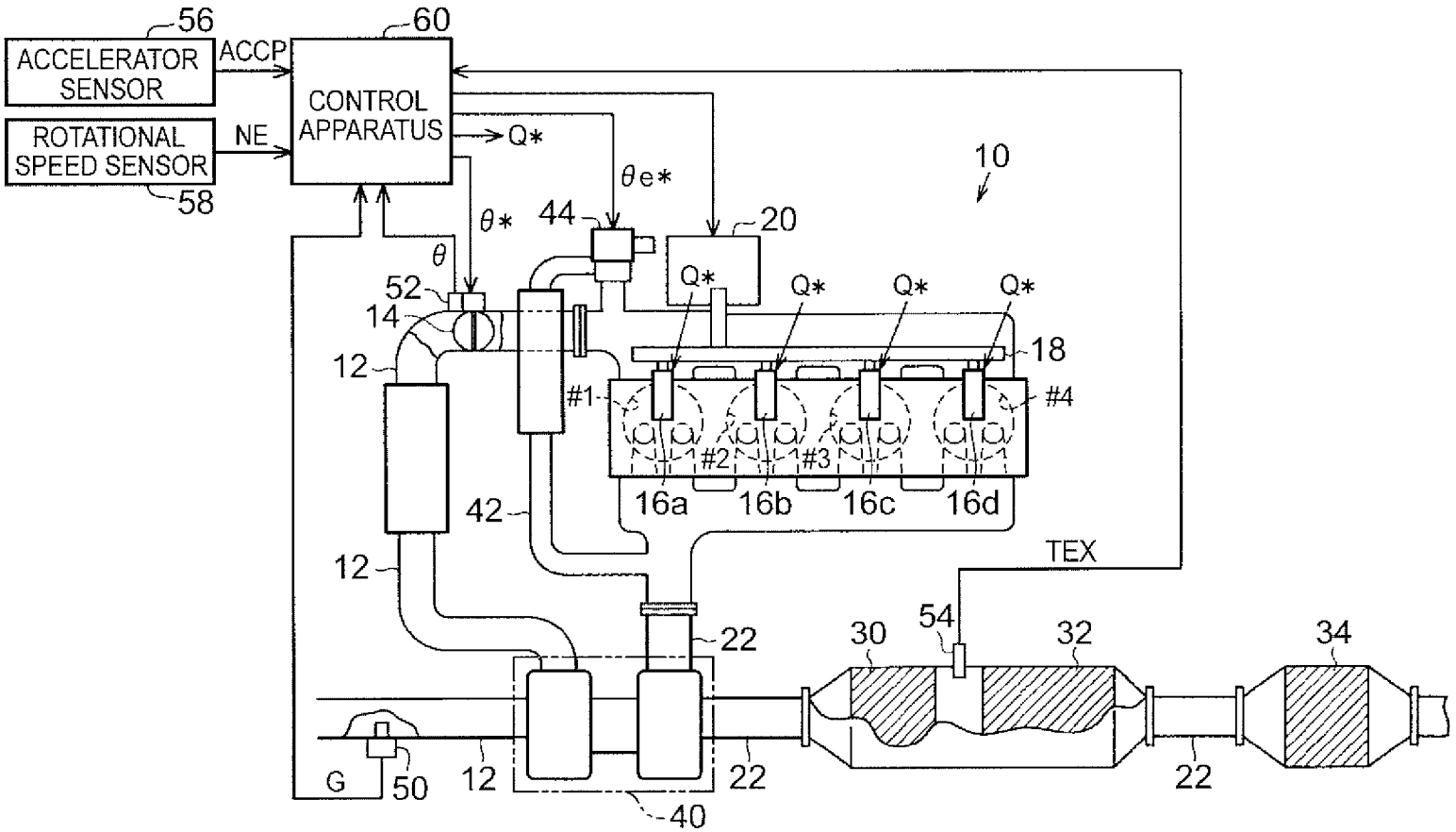
FIG. 1 is a system configuration diagram including a catalyst regeneration processing apparatus according to an embodiment.

Hereinafter, an embodiment of a catalyst regeneration processing apparatus will be described with reference to the drawings. An internal-combustion engine 10 shown in FIG. 1 is a compression-ignition internal-combustion engine that uses light oil as fuel, that is, a diesel engine. In an intake passage 12 of the internal-combustion engine 10, a throttle valve 14 for regulating the flow-passage cross-section area of the intake passage 12 is provided. Then, the intake passage 12 is connected with combustion chambers of cylinders #1 to #4. In the cylinders #1 to #4, fuel injection valves 16*a* to 16*d* are provided respectively, and to the fuel injection valves 16*a* to 16*d*, the fuel is fed from a pressure accumulating pipe 18. To the pressure accumulating pipe 18, the fuel pressurized by a high-pressure fuel pump 20 is fed. The air-fuel mixture of the fuel injected from the fuel injection valves 16*a* to 16*d* and the air having flowed from the intake passage 12 into the combustion chambers is compressed and ignited by the reduction of the volumes of the combustion chambers. Then, the air-fuel mixture after combustion is discharged to an exhaust passage 22, as exhaust gas.

In the exhaust passage 22, a NOx storage reduction catalyst (NSR 30), a particulate filter (DPF 32), and an H2S sweeper 34 are provided in order from the upstream side. In the case where the oxygen concentration in the exhaust gas flowing into the NSR 30 is high, the NSR 30 absorbs and accumulates (stores) NOx in the exhaust gas, and in the case where the oxygen concentration in the exhaust gas is low, the NSR 30 reacts the stored NOx with CO and HC in the exhaust gas, to purify the exhaust gas. The NOx storage function of the NSR 30 is actualized, for example, by including a compound (a barium compound or the like) with an alkali metal element, an alkaline-earth metal element or a rare-earth element. The DPF 32 traps the particulate matter in the exhaust gas flowing into the DPF 32. The H2S sweeper 34 accumulates oxygen and supports a transition metal such as ceria (CeO2), for example.

On the upstream side of the above intake passage 12 and exhaust passage 22, a supercharger 40 is provided. Further, the intake passage 12 is connected with the exhaust passage 22 through an exhaust gas recirculation passage 42, and in the exhaust gas recirculation passage 42, a recirculation valve 44 for regulating the flow-passage cross-section area of the exhaust gas recirculation passage 42 is provided.

On the intake passage 12, an air flow meter 50 to detect intake air quantity G is provided on the upstream side of the supercharger 40, and an opening angle sensor 52 to detect opening angle θ of the throttle valve 14 is provided near the throttle valve 14. Further, an exhaust gas temperature sensor 54 to detect the temperature of the exhaust gas is provided at a position that is on the downstream side of the NSR 30 and that is on the upstream side of the DPF 32. An accelerator sensor 56 detects manipulated quantity ACCP of the accelerator pedal, and a rotational speed sensor 58 detects the rotational speed of a crankshaft of the internal-combustion engine 10.

An electronic control unit 60 is a control apparatus that controls the internal-combustion engine 10. The electronic control unit 60 includes a central processing unit (CPU) and memory such as ROM and RAM, for example. The electronic control unit 60, to which the detection values of the above various sensors are input, manipulates various actuators such as the throttle valve 14, the fuel injection valves 16*a* to 16*d* and the recirculation valve 44, and thereby, controls controlled variables (torque, exhaust characteristic and the like) of the internal-combustion engine 10. Particularly, the electronic control unit 60 functions as a catalyst regeneration processing apparatus that performs the regeneration process of the NSR 30 for maintaining the controllability of the exhaust characteristic.

Figure 2:
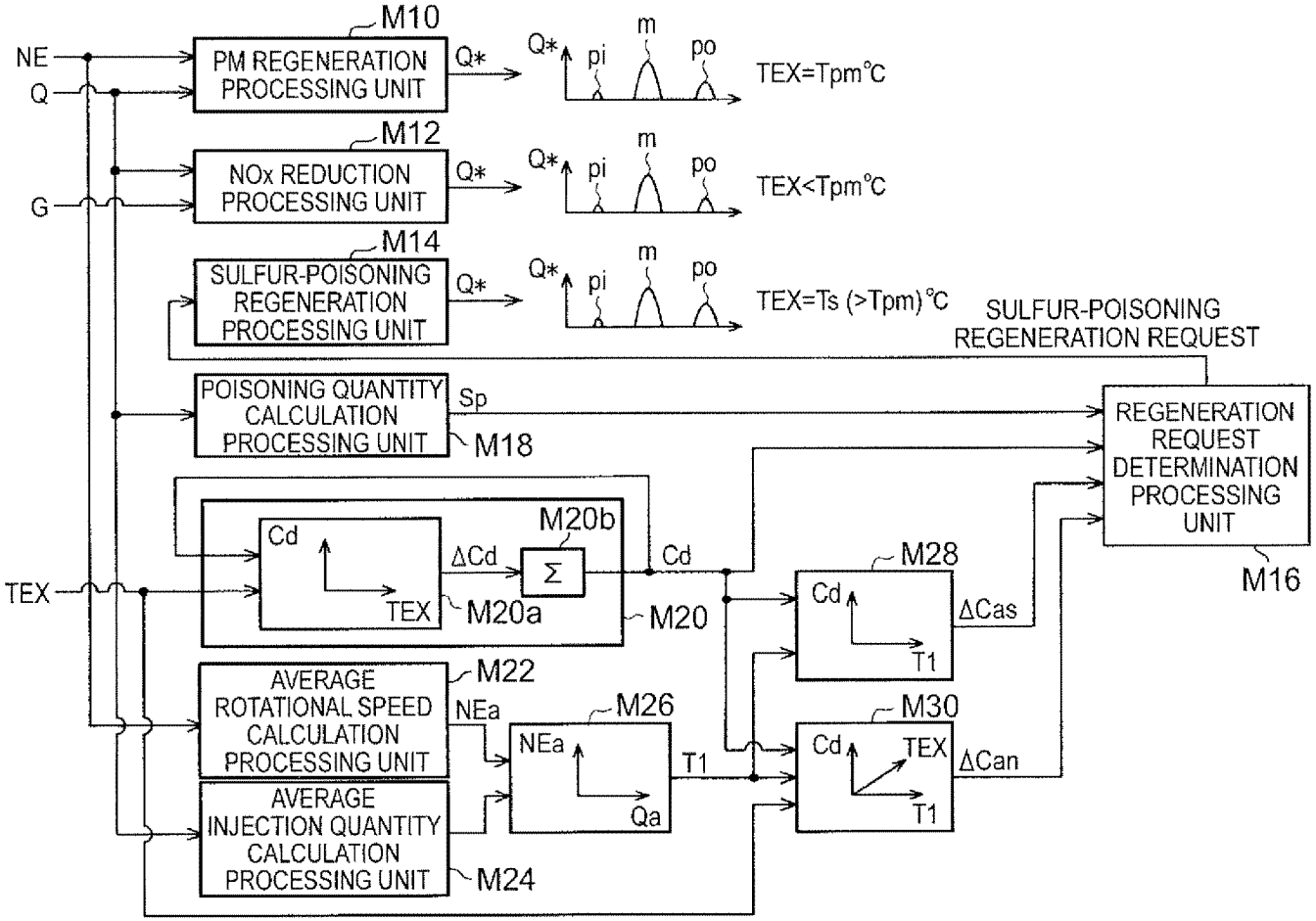
FIG. 2 is a block diagram showing some of the processes that are executed by a control apparatus according to the embodiment.

FIG. 2 shows processes that are performed by the electronic control unit 60 and that are particularly relevant to the regeneration of the NSR 30 and the DPF 32. A PM regeneration processing unit M10 estimates the quantity of the PM trapped by the DPF 32, based on rotational speed NE and injection quantity Q of the internal-combustion engine 10, and performs a PM regeneration process of removing the PM in the DPF 32 by combustion, in the case where the estimated PM quantity is a predetermined quantity or more. Specifically, a post-injection po is executed after a main injection m that contributes to the torque of the internal-combustion engine 10 and that exhibits a maximal injection quantity, and thereby, the PM is removed by combustion. On this occasion, the command value for the exhaust gas temperature in the DPF 32 is a PM regeneration temperature Tpm. Here, in FIG. 2, this is expressed by a formula showing that exhaust gas temperature TEX detected by the exhaust gas temperature sensor 54 is the PM regeneration temperature Tpm. Here, FIG. 2 describes that a well-known pilot injection pi is performed at a timing before the main injection m. Incidentally, the injection to be set by the PM regeneration processing unit M10 is the post-injection po, whereas the pilot injection pi and the main injection m are set by other well-known logics.

A NOx reduction processing unit M12 estimates the NOx storage quantity of the NSR 30, based on the intake air quantity G and the injection quantity Q, and executes a NOx reduction process of reducing the NOx stored in the NSR 30, in the case where the estimated NOx storage quantity is a predetermined quantity or more. This is a process of executing the post-injection po. Thereby, large amounts of unburnt fuel components such as HC and incomplete combustion components such as CO are contained in the exhaust gas to flow into the NSR 30, and they can be used as reducing agents for the NOx. On this occasion, the temperature of the NSR 30 is lower than the above PM regeneration temperature Tpm. Here, in FIG. 2, this is expressed by a formula showing that the exhaust gas temperature TEX detected by the exhaust gas temperature sensor 54 is lower than the PM regeneration temperature Tpm. Incidentally, the injection to be set by the NOx reduction processing unit M12 is the post-injection po, whereas the pilot injection pi and the main injection m are set by other well-known logics.

In the case where the NSR 30 absorbs sulfur and thereby a sulfur poisoning occurs, a sulfur-poisoning regeneration processing unit M14 executes a sulfur-poisoning regeneration process of regenerating the NSR 30. Here, the sulfur poisoning does not always mean that the NSR 30 absorbs sulfur as the simple substance. Actually, sulfur atoms are bound with alkali metals and the like in the NSR 30, and thereby, as sulfates, are tightly bound with substances in the NSR 30. When the sulfur poisoning quantity of the NSR 30 becomes large, the NOx storage capability of the NSR 30 decreases. On the contrary, in the case of increasing the frequency at which the NOx reduction processing unit M12 executes the NOx reduction process, the fuel consumption increases. In the sulfur-poisoning regeneration process according to the embodiment, although the cycle of the NOx reduction process is shortened, the NSR 30 with a decreased NOx storage capability is regenerated.

In detail, as the sulfur-poisoning regeneration process, the sulfur-poisoning regeneration processing unit M14 executes the post-injection po, and thereby executes a process of raising the temperature of the exhaust gas to flow into the NSR 30 and raising the CO concentration in the exhaust gas. Specifically, the sulfur-poisoning regeneration processing unit M14 alternately repeats a first mode of considerably delaying the injection timing of the post-injection po such that the fuel by the post-injection po reaches the NSR 30 as unburnt fuel and a second mode of advancing the injection timing of the post-injection po relative to the first mode, incompletely combusting the fuel by the post-injection po, and raising the CO concentration in the exhaust gas. On this occasion, the temperature of the NSR 30 (the exhaust gas temperature TEX detected by the exhaust gas temperature sensor 54) is a poisoning regeneration temperature Ts that is higher than the above PM regeneration temperature Tpm. In FIG. 2, this is expressed by a formula showing that the exhaust gas temperature TEX detected by the exhaust gas temperature sensor 54 is the poisoning regeneration temperature Ts. Here, in the embodiment, in the case of not performing any of the PM regeneration process, the NOx reduction process and the sulfur-poisoning regeneration process, the highest value of the exhaust gas temperature TEX is nearly equivalent to the PM regeneration temperature Tpm. Therefore, the exhaust gas temperature TEX when the sulfur-poisoning regeneration process is executed is higher than the highest value of the exhaust gas temperature TEX when the sulfur-poisoning regeneration process is not executed.

The sulfur-poisoning regeneration processing unit M14 executes the sulfur-poisoning regeneration process, with the condition that a sulfur-poisoning regeneration request is generated. In detail, after the sulfur-poisoning regeneration request is generated, the operation state of the internal-combustion engine 10 becomes a state in which the sulfur-poisoning regeneration process can be executed, so that the sulfur-poisoning regeneration process is executed. Therefore, for example, even when the sulfur-poisoning regeneration request is generated, the sulfur-poisoning regeneration processing unit M14 waits until the operation state of the internal-combustion engine 10 transitions to the state in which the sulfur-poisoning regeneration process can be executed, in the case where the operation state of the internal-combustion engine 10 is a state in which the sulfur-poisoning regeneration process cannot be executed, as exemplified by an idle operation state.

A poisoning quantity calculation processing unit M18 calculates a sulfur-poisoning quantity Sp of the NSR 30, based on the injection quantity Q from the fuel injection valves 16*a* to 16*d*. In detail, the poisoning quantity calculation processing unit M18 calculates the sulfur-poisoning quantity Sp repeatedly at a predetermined interval. For example, this can be actualized by previously storing, in the electronic control unit 60, the information about the content ratio of the sulfur contained in the fuel. That is, by multiplying the content ratio of the sulfur by the fuel injection quantity to be injected during the predetermined interval, the quantity of the sulfur in the exhaust gas can be calculated, and based on this, the sulfur-poisoning quantity of the NSR 30 can be calculated. Here, for example, an absorption ratio that is the quantity of the sulfur to be absorbed by the NSR 30 relative to the quantity of the sulfur in the exhaust gas is previously determined, and based on this, the sulfur-poisoning quantity of the NSR 30 may be calculated.

A deterioration calculation processing unit M20 calculates a heat deterioration degree Cd of the NSR 30, based on a history of the temperature of the NSR 30. Specifically, the exhaust gas temperature TEX is regarded as the temperature of the NSR 30, and the deterioration degree Cd is calculated based on the exhaust gas temperature TEX. In the case where the exhaust gas temperature TEX is high, the deterioration calculation processing unit M20 sets the deterioration degree Cd to a greater degree than that in the case where the exhaust gas temperature TEX is low. In the case where the total working time of the internal-combustion engine 10 is long, the deterioration calculation processing unit M20 sets the deterioration degree Cd to a greater degree than that in the case where the total working time of the internal-combustion engine 10 is short. Specifically, the deterioration calculation processing unit M20 calculates a progress degree ΔCd, in a progress degree calculation processing unit M20*a*, based on the deterioration degree Cd and the exhaust gas temperature TEX. Here, the progress degree ΔCd is an update quantity of the deterioration degree Cd. The progress degree ΔCd is set to a greater value as the exhaust gas temperature TEX is higher. Further, the progress degree ΔCd is set to a greater value as the deterioration degree is smaller. This is a setting reflecting that, in the case where the NSR 30 is new, the progress rate of the deterioration by heat is higher, compared to the case where the NSR 30 has been used for many years. The progress degree calculation processing unit M20*a* calculates the progress degree ΔCd in a predetermined cycle. Then, whenever the progress degree ΔCd is calculated in the predetermined cycle, the progress degree ΔCd is integrated by an integration processing unit M20*b*, so that the deterioration degree Cd is calculated.

An average rotational speed calculation processing unit M22 calculates the average value (average rotational speed NEa) of the rotational speed NE in a predetermined period. Here, the predetermined period is a time nearly equivalent in length to a time (for example, several minutes) ordinarily required to perform the sulfur-poisoning regeneration process. The average rotational speed calculation processing unit M22 updates the average rotational speed NEa at a predetermined interval, and the interval may be shorter than the above predetermined period.

An average injection quantity calculation processing unit M24 calculates the average value (average injection quantity Qa) of the injection quantity Q in the predetermined period. Here, the injection quantity Q does not involve the post-injection po. The average injection quantity calculation processing unit M24 updates the average injection quantity Qa at a predetermined interval, and the interval may be shorter than the above predetermined period.

A regeneration time prediction processing unit M26 predicts a predetermined time T1 that is a time required for the sulfur-poisoning regeneration process, based on the average rotational speed NEa and the average injection quantity Qa. In detail, the regeneration time prediction processing unit M26 takes in the latest average rotational speed NEa and average injection quantity Qa in a predetermined cycle, and updates the predetermined time T1 in the predetermined cycle. Here, the time required for the sulfur-poisoning regeneration process varies depending on the operation state of the internal-combustion engine 10 during the sulfur-poisoning regeneration process. Hence, in the embodiment, the average rotational speed NEa and the average injection quantity Qa are adopted as parameters for predicting the operation state of the internal-combustion engine 10 in the case where the sulfur-poisoning regeneration process is actually performed, and thereby, the predetermined time T1 is predicted. That is, the average rotational speed NEa and average injection quantity Qa show the most recent rotational speed NE and injection quantity Q, and therefore, have a correlation with the operation state of the internal-combustion engine 10 in a period during which the sulfur-poisoning regeneration process is performed.

A regeneration deterioration prediction processing unit M28 calculates a progress degree ΔCas of the heat deterioration of the NSR 30 in the predetermined time T1 in the case of assuming that the sulfur-poisoning regeneration process is executed for the predetermined time T1. Specifically, the regeneration deterioration prediction processing unit M28 takes in the latest predetermined time T1 and deterioration degree Cd in a predetermined cycle, and based on them, updates the progress degree ΔCas in the predetermined cycle. The progress degree ΔCas is set to a greater value as the predetermined time T1 is longer. Further, the progress degree ΔCas is set to a greater value as the deterioration degree Cd is smaller. The reason is the same as the reason why the progress degree calculation processing unit M20*a* uses the deterioration degree Cd in the calculation of the progress degree ΔCd. Here, the progress degree ΔCas is a predicted value for the increase amount of the deterioration degree Cd in the case where the sulfur-poisoning regeneration process is executed for the actual predetermined time T1. However, in the embodiment, in the calculation process of the progress degree ΔCas, approximation is performed on the assumption that the exhaust gas temperature TEX during the sulfur-poisoning regeneration process is a fixed value (poisoning regeneration temperature Ts).

An ordinary deterioration prediction processing unit M30 predicts a progress degree ΔCan of the heat deterioration of the NSR 30 in the predetermined time T1 in the case where the sulfur-poisoning regeneration process is not executed for the predetermined time T1. Specifically, the ordinary deterioration prediction processing unit M30 takes in the latest values of the predetermined time T1, the exhaust gas temperature TEX and the deterioration degree Cd, in a predetermined cycle, and based on them, updates the progress degree ΔCan in the predetermined cycle. Here, the progress degree ΔCan is set to a greater value as the predetermined time T1 is longer. Further, the progress degree ΔCan is set to a greater value as the exhaust gas temperature TEX is higher. Furthermore, the progress degree ΔCan is set to a greater value as the deterioration degree Cd is smaller. The reason is the same as the reason why the progress degree calculation processing unit M20*a* uses the deterioration degree Cd in the calculation of the progress degree ΔCd.

Figure 3:
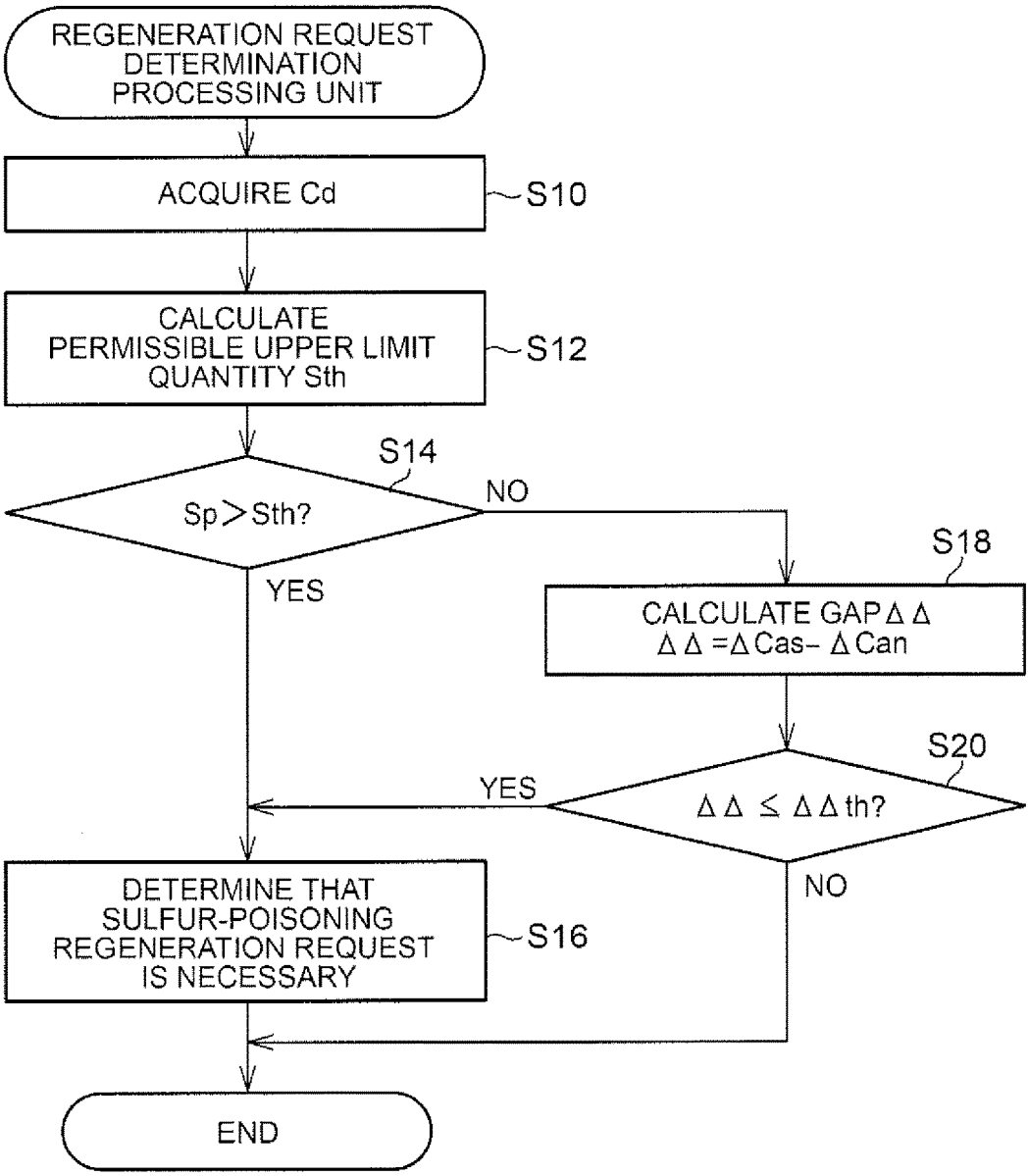
FIG. 3 is a flowchart showing a procedure of processes by a regeneration request determination processing unit according to the embodiment.

A regeneration request determination processing unit M16 determines whether a sulfur-poisoning regeneration request is necessary, based on the sulfur poisoning quantity Sp, the deterioration degree Cd, the progress degree ΔCas and the progress degree ΔCan. FIG. 3 shows a procedure of processes that are executed by the regeneration request determination processing unit M16. The processes, for example, are executed repeatedly in a predetermined cycle, by the regeneration request determination processing unit M16.

In the series of processes, the regeneration request determination processing unit M16, first, acquires the deterioration degree Cd calculated by the deterioration calculation processing unit M20 (S10). Next, the regeneration request determination processing unit M16 calculates a permissible upper limit quantity Sth of the sulfur poisoning quantity Sp, based on the deterioration degree Cd (S12). Here, the permissible upper limit quantity Sth is the upper limit quantity of the sulfur poisoning for which the sulfur-poisoning regeneration process does not need to be executed. In the case where the deterioration degree Cd is great, the permissible upper limit quantity Sth is set to a smaller quantity than that in the case where the deterioration degree Cd is small. This is because the NOx storage capability of the NSR 30 decreases when the heat deterioration of the NSR 30 progresses. That is, the factor of the decrease in the NOx storage capability of the NSR 30 includes sulfur poisoning and heat deterioration. Then, in the case of executing the sulfur-poisoning regeneration process because the NOx storage capability becomes a permissible lower limit value, it is increasingly demanded to execute the sulfur-poisoning regeneration process even when the sulfur poisoning quantity Sp is small, as the heat deterioration progresses.

Next, the regeneration request determination processing unit M16 determines whether the sulfur poisoning quantity Sp exceeds the permissible upper limit quantity Sth (S14). Then, in the case of determining that the sulfur poisoning quantity Sp exceeds the permissible upper limit quantity Sth (S14: YES), the regeneration request determination processing unit M16 determines that the regeneration request is necessary (S16).

On the other hand, in the case of determining that the sulfur poisoning quantity Sp is the permissible upper limit quantity or less (S14: NO), the regeneration request determination processing unit M16 calculates a gap ΔΔ by subtracting the progress degree ΔCan calculated by the ordinary deterioration determination processing unit M30 from the progress degree ΔCas calculated by the regeneration deterioration prediction processing unit M28 (S18).

Next, the regeneration request determination processing unit M16 determines whether the gap ΔΔ is a predetermined degree ΔΔth or less (S20). The process is a process of determining whether the difference in the progress degree of the heat deterioration of the NSR 30 between the case where the sulfur-poisoning regeneration process is executed and the case where the sulfur-poisoning regeneration process is not executed is small. The process is a process for determining whether the sulfur-poisoning regeneration request is necessary. That is, if the above difference in the progress degree of the heat deterioration is small, even when the sulfur-poisoning regeneration process is executed, the process does not cause a large progress of the heat deterioration of the NSR 30. Then, in the case where the sulfur-poisoning regeneration process is executed in such a situation, the frequency at which the sulfur poisoning quantity Sp is determined to exceed the permissible upper limit quantity Sth decreases, compared to the case where the sulfur-poisoning regeneration process is not executed. Here, in the case where the sulfur poisoning quantity Sp is determined to exceed the permissible upper limit quantity Sth and the sulfur-poisoning regeneration process is executed, the heat deterioration of the NSR 30 may progress largely compared to the case of assuming that the sulfur-poisoning regeneration process is not executed. Therefore, for suppressing the progress of the heat deterioration of the NSR 30 that is caused by the sulfur-poisoning regeneration process, the sulfur-poisoning regeneration request is generated not only in the case where the sulfur poisoning quantity Sp exceeds the permissible upper limit quantity Sth but also in the case where the gap ΔΔ is the predetermined degree ΔΔth or less.

Here, the above predetermined time T1 is a parameter that is used for the determination. Therefore, it is not always necessary to accurately predict the time required for the sulfur-poisoning regeneration process. For example, in the case where the internal-combustion engine 10 is predicted to be operated at a relatively low load because the average injection quantity Qa is small, the predetermined time T1 may be purposely set to a much greater value than the time required for the process in the case where the internal-combustion engine 10 is actually operated at a low load and the sulfur-poisoning regeneration process is executed. Thereby, in the case where it is predicted that a period in which the operation state of the internal-combustion engine 10 is a low load state is long in the sulfur-poisoning regeneration process, the gap ΔΔ can surely exceed the predetermined degree ΔΔth.

In the case of determining that the gap ΔΔ is the predetermined degree ΔΔth or less (S20: YES), the regeneration request determination processing unit M16 determines that the sulfur-poisoning regeneration request is necessary (S16). Here, in the case of completing the process of step S16 or in the case of making the negative determination in step S20, the regeneration request determination processing unit M16 finishes the series of processes once.

In the following, the function of the embodiment will be described. In the case where the regeneration request determination processing unit M16 determines that the sulfur poisoning quantity Sp exceeds the permissible upper limit quantity Sth, the sulfur-poisoning regeneration processing unit M14 determines whether the operation state of the internal-combustion engine 10 is an operation state in which the sulfur-poisoning regeneration process can be executed. Then, in the case of determining that the operation state of the internal-combustion engine 10 is an operation state in which the sulfur-poisoning regeneration process can be executed, the sulfur-poisoning regeneration processing unit M14 executes the sulfur-poisoning regeneration process.

On the other hand, even in the case of determining that the sulfur poisoning quantity Sp does not exceed the permissible upper limit quantity Sth, the regeneration request determination processing unit M16 determines that the sulfur-poisoning regeneration request is necessary, in the case of determining that the gap ΔΔ between the progress degrees ΔCas, ΔCan of the heat deterioration is the predetermined degree ΔΔth or less. In this case, since the operation state of the internal-combustion engine 10 is an operation state in which the sulfur-poisoning regeneration process can be executed, the sulfur-poisoning regeneration processing unit M14 executes the sulfur-poisoning regeneration process immediately.

According to the embodiment described above, the following effects are obtained. (1) In the case of determining that the gap ΔΔ is the predetermined degree ΔΔth or less, the electronic control unit 60 executes the sulfur-poisoning regeneration process. Therefore, although there is no great difference in the progress degree of the deterioration of the NSR 30 from the case where the regeneration process is not executed, the sulfur poisoning quantity is reduced. Thereby, it is possible to decrease the frequency at which the sulfur poisoning quantity Sp exceeds the permissible upper limit quantity Sth. In the case where the sulfur poisoning quantity Sp is determined to exceed the permissible upper limit quantity Sth and the sulfur-poisoning regeneration process is executed, the heat deterioration of the NSR 30 may progress largely compared to the case of assuming that the sulfur-poisoning regeneration process is not executed. Therefore, according to the embodiment allowing for the decrease in the frequency at which the sulfur poisoning quantity Sp exceeds the permissible upper limit quantity Sth, it is possible to suppress the progress of the heat deterioration of the NSR 30.

(2) The progress degree ΔCan is predicted based on the current temperature of the NSR 30 (the exhaust gas temperature TEX detected by the exhaust gas temperature sensor 54). Here, in a period nearly equivalent to the execution time of the sulfur-poisoning regeneration process, it is likely that the change quantity of the temperature of the NSR 30 increases little. Therefore, it is possible to approximate a near-future temperature of the NSR 30 in the period nearly equivalent to the execution time of the regeneration process, with a high accuracy, by the current temperature of the NSR 30. Accordingly, it is possible to predict the progress degree ΔCan, with a high accuracy.

(3) The progress degree ΔCan in the predetermined time T1 in the case where the sulfur-poisoning regeneration process is not executed is predicted in consideration of the deterioration degree Cd. Thereby, it is possible to perform a prediction that reflects the dependence of the progress degree of the heat deterioration on the deterioration degree at the current time point, and therefore, it is possible to predict the progress degree ΔCan with a higher accuracy.

(4) The progress degree ΔCas in the predetermined time T1 in the case where the sulfur-poisoning regeneration process is executed is predicted based on the deterioration degree Cd. Thereby, it is possible to perform a prediction that reflects the dependence of the progress degree of the heat deterioration on the deterioration degree at the current time point, and therefore, it is possible to predict the progress degree ΔCas with a higher accuracy.

(5) The time required for the regeneration process in the case where the sulfur-poisoning regeneration process is executed is predicted, as the predetermined time T1, based on the average rotational speed NEa and the average injection quantity Qa. Thereby, it is possible to predict the time required for the regeneration process with a high accuracy.

(6) The permissible upper limit quantity Sth is set based on the deterioration degree Cd. Thereby, the permissible upper limit quantity Sth can be set so as to be variable depending on the heat deterioration degree of the NSR 30. Therefore, it is possible to suppress the execution of the regeneration process, and furthermore, it is possible to suppress the heat deterioration of the NSR 30.

Other Embodiments

Here, at least one of the features of the above embodiment may be modified as follows. In the following, there are parts in which correspondence relations between features described in the section "SUMMARY OF THE INVENTION" and features in the above embodiment are exemplified by reference characters and the like, but the intent is to not limit the above features to the exemplified correspondence relations.

[Poisoning Quantity Calculation Processing Unit (M18)] In the above embodiment, the concentration of the sulfur contained in the fuel is previously stored, and the values resulting from multiplying the injection quantities Q at the respective injections by the concentration of the sulfur are integrated. Thereby, the sulfur poisoning quantity is calculated. However, the embodiments are not limited to this. For example, on the exhaust passage 22, a sensor to detect the concentration of sulfur oxide may be provided on the upstream side of the NSR 30, and the sulfur poisoning quantity may be calculated based on the detection value of the sensor.

[Deterioration Calculation Processing Unit (M20)] In the above embodiment, the output value of the integration processing unit M20*b* may be corrected depending on the mileage of a vehicle and the total working time of the internal-combustion engine 10.

In the above embodiment, the update quantity ΔCd of the deterioration degree Cd is decided depending on the current deterioration degree Cd, but the embodiments are not limited to this. On this occasion, for example, the deterioration degree Cd may be calculated in consideration of the mileage of the vehicle and the total working time of the internal-combustion engine 10. This can be actualized, for example, by deciding the update quantity ΔCd of the deterioration degree Cd depending on the mileage of the vehicle and the total working time of the internal-combustion engine 10.

Further, instead of this, the output value of the integration processing unit M20*b* may be corrected depending on the mileage of the vehicle and the total working time of the internal-combustion engine 10.

[Ordinary Deterioration Prediction Processing Unit (M30)] In the above embodiment, the progress degree ΔCan of the heat deterioration is calculated from the exhaust gas temperature TEX, the predetermined time T1 and the deterioration degree Cd, but the embodiments are not limited to this. For example, the progress degree ΔCan of the heat deterioration may be calculated based on only the two parameters of the exhaust gas temperature TEX and the predetermined time T1.

The embodiments are not limited to a configuration of calculating the progress degree ΔCan of the heat deterioration in the case of assuming that the temperature of the NSR 30 is maintained for the predetermined time T1. For example, the change in the temperature of the NSR 30 in a period after the current time and before the elapse of the predetermined time T1 may be predicted, and the progress degree ΔCan of the heat deterioration may be calculated based on the predicted temperature. Here, for example, in the case where a running route (destination) for the vehicle is input to an in-vehicle navigation device, the prediction of the temperature of the NSR 30 can be actualized by predicting the operation state of the internal-combustion engine 10 based on a running route until the elapse of the predetermined time T1.

[Regeneration Deterioration Prediction Processing Unit (M28)] In the above embodiment, the progress degree ΔCas of the heat deterioration is calculated based on the two parameters of the deterioration degree Cd and the predetermined time T1, but the embodiments are not limited to this. For example, the predicted value of the average value of the temperature of the NSR 30 during the regeneration process or the like may be considered. Here, for example, the predicted value can be calculated from the average rotational speed NEa and the average injection quantity Qa.

Further, for example, the progress degree ΔCas of the heat deterioration may be calculated based on only the predetermined time T1 Furthermore, for example, the progress degree ΔCas of the heat deterioration may be a previously decided value.

[Regeneration Request Determination Processing Unit (M16)] In the case where the progress degree ΔCas of the heat deterioration is a previously decided value as described in the section "Regeneration Deterioration Prediction Processing Unit", it is possible that the process of step S18 in FIG. 3 is removed and the determination process of whether the progress degree ΔCan of the heat deterioration is a threshold or more is executed instead of the process of step S20. Here, the threshold is decided depending on the progress degree ΔCas of the heat deterioration. Further, the embodiments are not limited to a configuration of comparing the progress degree ΔCan of the heat deterioration and the threshold. For example, a determination process of whether the current temperature of the NSR 30 (exhaust gas temperature TEX) is a threshold or more may be executed instead of the process of step S20. The current temperature of the NSR 30 (exhaust gas temperature TEX) here corresponds to the progress degree ΔCan of the heat deterioration in the case where the predetermined time T1 is a previously set fixed value, in a configuration in which the progress degree ΔCan of the heat deterioration is calculated based on only the two parameters of the exhaust gas temperature TEX and the predetermined time T1.

In FIG. 3, when the gap ΔΔ is the predetermined degree ΔΔth or less, the determination that the sulfur-poisoning regeneration request is necessary is made in step S20, but the embodiments are not limited to this. For example, in the case where the logical product between a first condition that is a condition that the gap ΔΔ is the predetermined degree ΔΔth or less and a second condition that is a condition that the sulfur poisoning quantity Sp is a specified quantity or more is true, the determination that the sulfur-poisoning regeneration request is necessary may be made. Further, for example, the above second condition may be replaced with a condition that the mileage from the last execution of the sulfur-poisoning regeneration process is a predetermined distance or more, a condition that the total working time of the internal-combustion engine 10 from the last execution of the sulfur-poisoning regeneration process is a specified time or more, or a condition that the integrated quantity of the fuel injection quantity from the last execution of the sulfur-poisoning regeneration process is a predetermined quantity or more. Thereby, it is possible to decrease the frequency at which the sulfur-poisoning regeneration process is executed.

[Regeneration Time Prediction Processing Unit (M26)] In the calculation of the predetermined time T1, the sulfur poisoning quantity Sp may be considered. In this case, the predetermined time T1 may be set to a greater value as the sulfur poisoning quantity Sp increases.

[Sulfur-Poisoning Regeneration Processing Unit (M14)] The embodiments are not limited to a configuration in which the exhaust gas temperature TEX is controlled by the manipulation of the injection quantity of the post-injection po. For example, in a configuration in which a fuel addition valve for adding the fuel to the exhaust gas is provided in the exhaust passage 22 of the internal-combustion engine, the exhaust gas temperature TEX may be controlled by the manipulation of the quantity of the fuel that is added from the fuel addition valve.

[Temperature of NSR 30] The embodiments are not limited to a configuration in which the exhaust gas temperature TEX detected by the exhaust gas temperature sensor 54 is regarded as the temperature of the NSR 30. For example, the temperature of the NSR 30 may be estimated based on the detection value of a sensor to detect the temperature on the upstream side of the NSR 30 and the heat capacity of the NSR 30. Further, the temperature of the NSR 30 may be estimated based on the rotational speed NE and the load.

[Upper Limit Quantity Setting Processing Unit (S12)] In FIG. 3, the processes of steps S10, S12, S14, S16 and the processes of steps S18, S20, S16 may be processes that are executed independently of each other. In this case, a configuration in which the regeneration request determination processing unit does not include an upper limit quantity setting processing unit may be adopted.

Further, the upper limit quantity setting processing unit is not essential. That is, in FIG. 3, the processes of steps S10, S12 may be removed, and whether the sulfur poisoning quantity Sp exceeds a previously decided permissible upper limit quantity Sth may be determined in step S14.

[Addition] In the above embodiment, it is assumed that the temperature of the NSR 30 peaks at the time of the sulfur-poisoning regeneration process, but the embodiments are not limited to this. Even when a situation in which the temperature of the NSR 30 is higher than that at the time of the sulfur-poisoning regeneration process occurs, the execution of the processes in FIG. 3 allows the sulfur-poisoning regeneration process to be executed when the gap in the progress degree of the heat deterioration between the case where the sulfur-poisoning regeneration process is executed and the case where the sulfur-poisoning regeneration process is not executed is small.

The NOx catalyst is not limited to the NSR 30. The internal-combustion engine is not limited to the compression-ignition internal-combustion engine. For example, the internal-combustion engine may be a spark-ignition internal-combustion engine such as a gasoline engine.

What is claimed is:

1. A catalyst regeneration processing apparatus for an internal-combustion engine, the internal-combustion engine including a NOx catalyst that is disposed in an exhaust passage, the catalyst regeneration processing apparatus comprising:

an electronic control unit configured to (i) calculate a sulfur poisoning quantity of the NOx catalyst, (ii) control the internal-combustion engine such that a regeneration process is executed, in a case where the sulfur poisoning quantity exceeds a permissible upper limit quantity, the regeneration process being a process of raising a temperature of the NOx catalyst so as to reduce the sulfur poisoning quantity, (iii) determine whether a gap is equal to a predetermined degree or less, the gap being a difference between (a) a progress degree of heat deterioration of the NOx catalyst in a predetermined time in a case of assuming that the regeneration process is executed for the predetermined time and (b) a progress degree of heat deterioration of the NOx catalyst in the predetermined time in a case of assuming that the regeneration process is not executed, and (iv) execute the regeneration process in a case of determining that the gap is equal to the predetermined degree or less, even when the sulfur poisoning quantity does not exceed the permissible upper limit quantity.

2. The catalyst regeneration processing apparatus according to claim 1, wherein the electronic control unit is configured to determine whether the gap is equal to the predetermined degree or less, based on a current value of the temperature of the NOx catalyst.

3. The catalyst regeneration processing apparatus according to claim 2, wherein the electronic control unit is configured to (1) predict the progress degree of heat deterioration of the NOx catalyst in the predetermined time in the case of assuming that the regeneration process is not executed, based on the current value of the temperature of the NOx catalyst, and (2) determine whether the gap is equal to the predetermined degree or less, based on the progress degree of heat deterioration predicted based on the current value of the temperature of the NOx catalyst.

4. The catalyst regeneration processing apparatus according to claim 3, wherein the electronic control unit is configured to calculate a deterioration degree of the NOx catalyst, based on a history of the temperature of the NOx catalyst, and the electronic control unit is configured to predict the progress degree of heat deterioration, based on the deterioration degree calculated based on the history.

5. The catalyst regeneration processing apparatus according to claim 1, wherein the electronic control unit is configured to (1) calculate a deterioration degree of the NOx catalyst based on a history of the temperature of the NOx catalyst, (2) predict the progress degree of heat deterioration of the NOx catalyst in the predetermined time in the case of assuming that the regeneration process is executed for the predetermined time, based on the deterioration degree calculated based on the history, and (3) determine whether the gap is equal to the predetermined degree or less, based on the predicted progress degree of heat deterioration.

6. The catalyst regeneration processing apparatus according to claim 1, wherein the electronic control unit is configured to predict a time required for the regeneration process in a case where the regeneration process is executed, based on an average rotational speed and an average injection quantity of the internal-combustion engine in a predetermined period, and the predetermined time is the predicted time required for the regeneration process.

7. The catalyst regeneration processing apparatus according to claim 1, wherein the electronic control unit is configured to set the permissible upper limit quantity, based on a history of the temperature of the NOx catalyst.

8. The catalyst regeneration processing apparatus according to claim 1, wherein the temperature of the NOx catalyst in the regeneration process is higher than a highest value of the temperature of the NOx catalyst in a case where the regeneration process is not executed.

* * * * *